US006879093B2

(12) United States Patent
Diven et al.

(10) Patent No.: US 6,879,093 B2
(45) Date of Patent: Apr. 12, 2005

(54) DAMPER WIRE SPRING FOR A CATHODE RAY TUBE

(75) Inventors: Gary Lee Diven, Lancaster, PA (US); Joseph Arthur Reed, York, PA (US)

(73) Assignee: Thomson Licensing S.A., Boulogne-Billancourt (FR)

( * ) Notice: Subject to any disclaimer, the term of this patent is extended or adjusted under 35 U.S.C. 154(b) by 315 days.

(21) Appl. No.: 09/747,207

(22) Filed: Dec. 22, 2000

(65) Prior Publication Data

US 2002/0079813 A1 Jun. 27, 2002

(51) Int. Cl.[7] ..... H01J 29/80
(52) U.S. Cl. ..... 313/405; 313/402; 445/30
(58) Field of Search ..... 445/30, 37; 313/269, 313/40, 50, 402, 404, 405, 407, 408; 248/636; 181/207, 209

(56) References Cited

U.S. PATENT DOCUMENTS 4,682,965 A * 7/1987 Kume et al. ..... 445/37
4,780,641 A * 10/1988 Hashiba et al. ..... 313/269
5,391,957 A * 2/1995 Fendley ..... 313/402
5,394,051 A * 2/1995 Lerner ..... 313/403
5,672,935 A * 9/1997 Ito et al. ..... 313/406

FOREIGN PATENT DOCUMENTS

JP 405128980 * 5/1993 ..... 313/402

* cited by examiner

*Primary Examiner*—Edward J. Glick
*Assistant Examiner*—Elizabeth Keaney
(74) *Attorney, Agent, or Firm*—Joseph S. Tripoli; Harvey D. Fried; Patricia A. Verlangieri

(57) ABSTRACT

An apparatus and method for retaining a damper wire used in a cathode ray tube to reduce vibration in the grill type mask assembly of a cathode ray tube. The damper wire is retained across a grill type mask by a bimetal damper spring having a first end and an opposing second end. The second end is coupled to the frame of the grill type mask assembly. A tab located proximate the first end of the damper spring is adapted to accept the damper wire that traverses the mask.

13 Claims, 8 Drawing Sheets

DAMPER WIRE SPRING FOR A CATHODE RAY TUBE

This invention generally relates to cathode ray tubes and, more particularly, to an apparatus and method for retaining a damper wire in a cathode ray tube to reduce vibration in a grille type mask.

BACKGROUND OF THE INVENTION

A color picture tube includes an electron gun for forming and directing three electron beams to a screen of the tube. The screen is located on the inner surface of the face plate of the tube and comprises an array of elements of three different color emitting phosphors. A shadow mask, which may be either a formed aperture or a grill type mask, is interposed between the gun and the screen to permit each electron beam to strike only the phosphor elements associated with that beam.

The shadow mask is subject to vibration from external sources (e.g., speakers near the tube). Such vibration varies the positioning of the apertures through which the electron beam passes, resulting in visible display fluctuations. Ideally, these vibrations need to be eliminated or, at least, mitigated to produce a commercially viable television picture tube.

SUMMARY OF THE INVENTION

The present invention provides an apparatus and method for retaining a damper wire used in a cathode ray tube to reduce vibration in a grill type mask assembly of a cathode ray tube. The damper wire is retained across a mask by a bimetal damper spring having a first end and an opposing second end. The second end is coupled to the frame of the grill type mask assembly. A tab located proximate the first end of the damper spring is adapted to accept the damper wire that traverses the mask. In an alternative embodiment, the damper wire is "tied" to the tab such that the spring maintains a constant tension on the damper wire.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
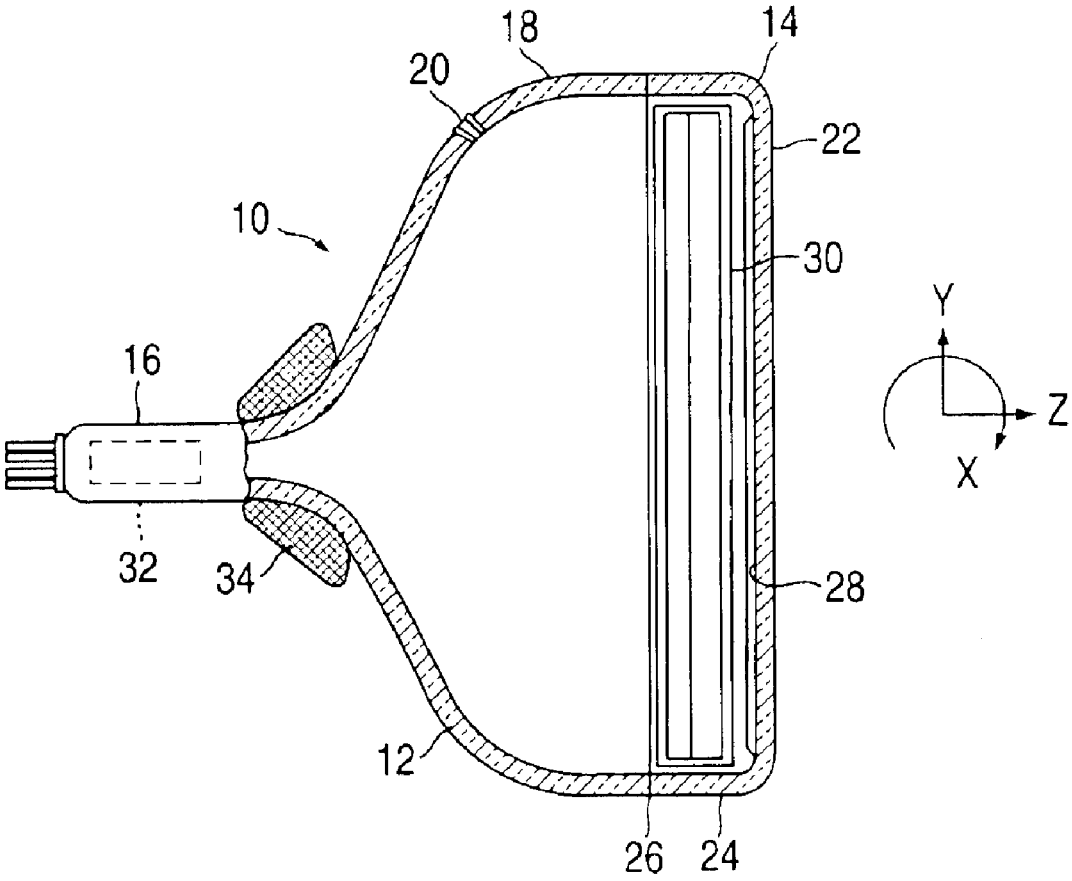
FIG. 1 is a side view, partly in axial section, of a color picture tube, including a grill type mask-frame-assembly according to the present invention.

FIG. 1 shows a cathode ray tube 10 having a glass envelope 12 comprising a rectangular face plate panel 14 and a tubular neck 16 connected by a rectangular funnel 18. The funnel 18 has an internal conductive coating (not shown) that extends from an anode button 20 to a neck 16. The panel 14 comprises a viewing face plate 22 and a peripheral flange or sidewall 24 that is sealed to the funnel 18 by a glass frit 26. A three-color phosphor screen 28 is carried by the inner surface of the face plate 22. The screen 28 is a line screen with the phosphor lines arranged in triads, each triad including a phosphor line of each of the three colors. A grill type mask 30 is removably mounted in a predetermined spaced relation to the screen 28. An electron gun 32 (schematically shown by the dashed lines in FIG. 1) is centrally mounted within the neck 16 to generate three in-line electron beams, a center beam and two side beams, along convergent paths through the mask 30 to the screen 28.

The tube 10 is designed to be used with an external magnetic deflection yoke, such as the yoke 34 shown in the neighborhood of the funnel to neck junction. When activated, the yoke 34 subjects the three beams to magnetic fields that cause the beams to scan horizontally and vertically in a rectangular raster over the screen 28.

Figure 2:
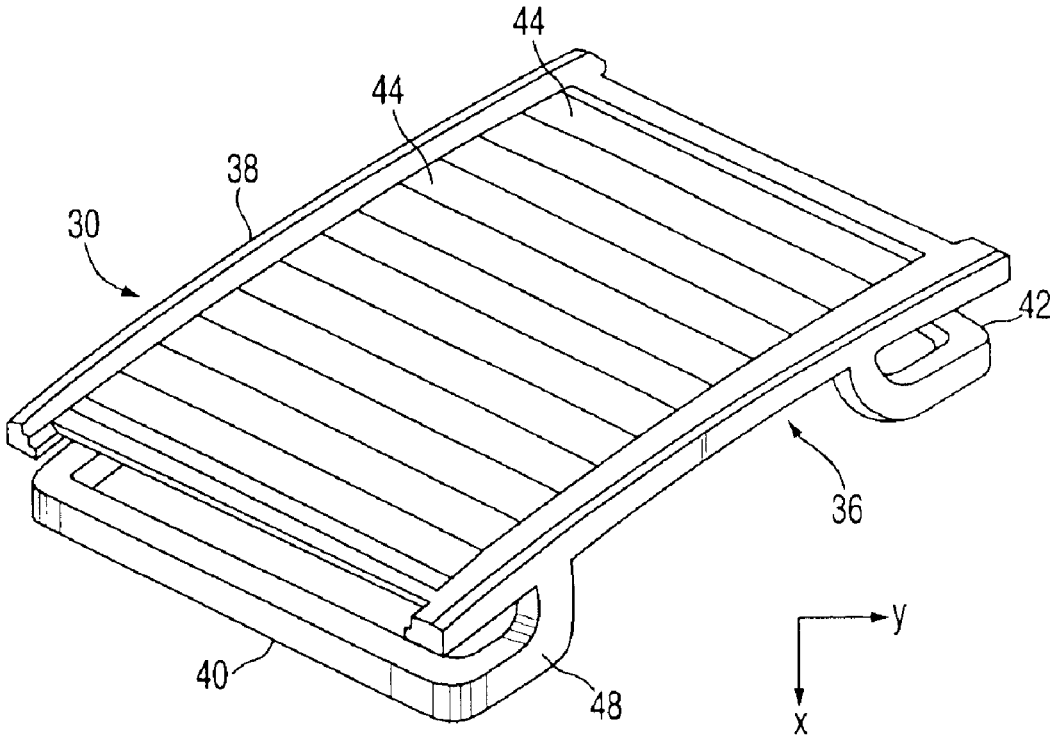
FIG. 2 is a perspective view of the grill type mask-frame-assembly of FIG. 1.

The grill type mask 30, shown in greater detail in FIG. 2, includes two long sides 36 and 38 and two short sides 40 and 42. The two long sides 36 and 38 of the mask parallel a central major access, x, of the tube. The grill type mask 30 includes: strands 44 that are parallel to the central minor access y and to each other. In a preferred embodiment, the strands 44 are flat strips that extend vertically, having a width of about 0.020" and a thickness of 0.006".

It will be appreciated by those skilled in the art that although the invention is discussed in the context of grill type masks, the invention can be adapted to use formed aperture masks, tensed aperture masks, focus type masks or the like.

Figure 3:
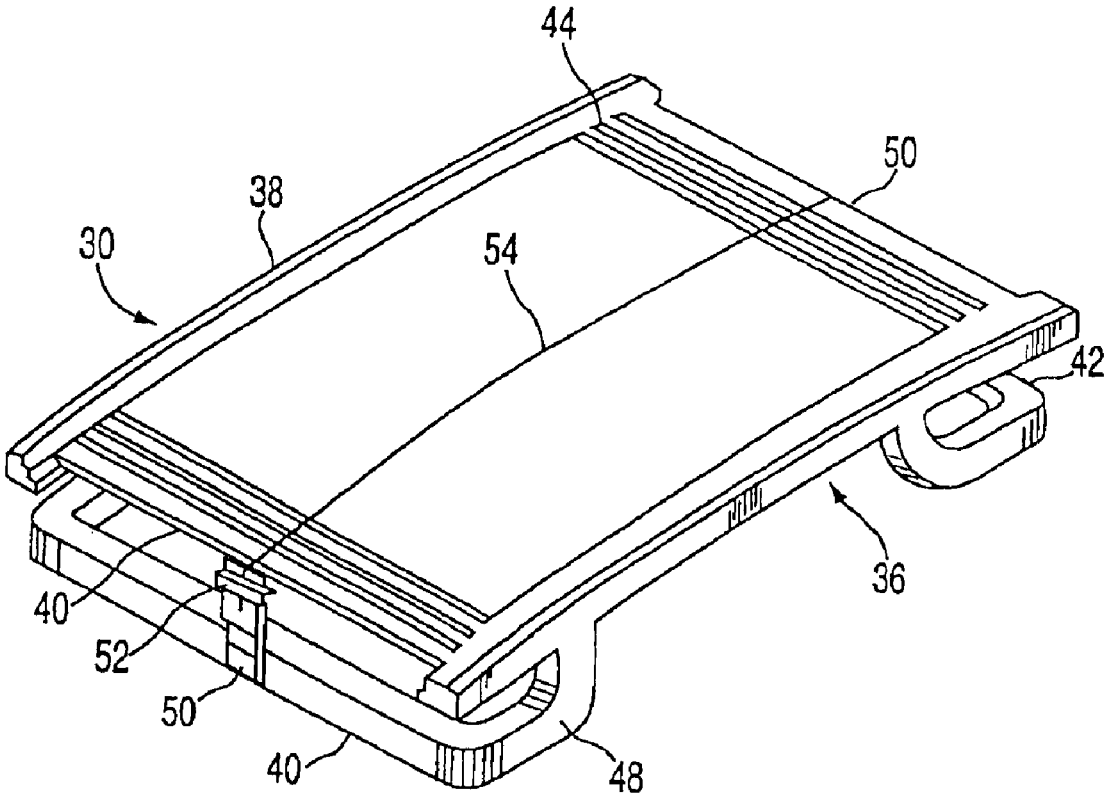
FIG. 3 PRIOR ART
FIG. 3 depicts a prior art damper spring arrangement.

FIG. 3 depicts a prior art (U.S. Pat. No. 4,780,641) damper spring arrangement that retains a damper wire across the mask to reduce vibration in the mask. Specifically, a damper spring 50 is attached to a frame 48 of grill type mask 30. More specifically, each damper spring 50 is comprised of a single metal and is attached to the frame 48 proximate to the two short sides 40 and 42 of grill type mask 30. A tab 52 is disposed on each damper spring 50.

A damper wire 54 extends between the damper springs 50 and contacts the surface of the grill type mask 30. The damper wire 54 is attached to each respective damper spring 50 by sandwiching the damper wire 54 between the spring 50 and a tab 52 welded to the spring 52.

Figure 4:
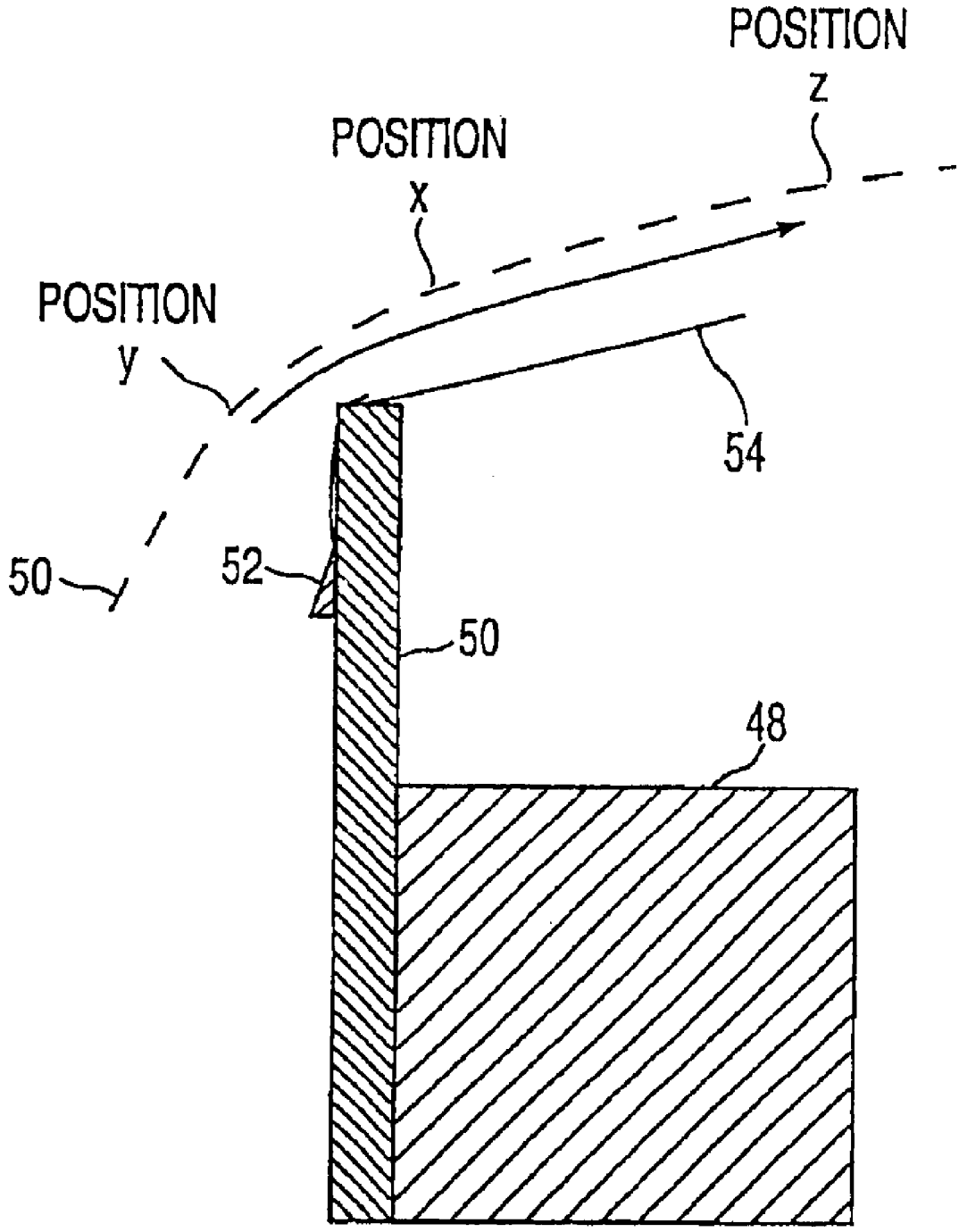
FIG. 4 PRIOR ART
FIG. 4 is a cross sectional view of a prior art damper spring depicting positional movement during temperature changes.

Damper wire 54 is held under a high tension force of 50 N between each respective damper spring 50. It is desireable that this tension be maintained to ensure that the damper wire 54 is always contacting the mask. Damper wire 54 is a small diameter wire made of tungsten or the like. Under a normal operating temperature of 70 degrees Celsius, each respective damper spring 50 maintains the proper tension on damper wire 54. However, during the cathode ray tube manufacturing process, temperatures in the cathode ray tube 10 can reach temperature ranges of between 450 and 480 degrees Celsius. Because the creep threshold of the damper spring and damper wire material at the processing temperature is lower than the creep threshold at normal operating temperature and the thermal expansion of the damper wire 54 causes an increase in wire tension and spring stress at the high processing temperature, such a high temperature can cause creep strain in the damper spring or damper wire which leads to a relaxation of the damper wire tension and a resultant damper wire tension which can only be estimated from initial conditions. For instance, during high temperature processing as shown in FIG. 4, damper spring 50 moves from Position x to Position y exerting additional direct tension on damper wire 54 and increased bending stress on the damper spring 50. Creep strain in the damper spring 50 will move the damper spring 50 towards Position x. When normal operating temperatures are reverted to, the permanent creep strain will position the damper spring 50 at Position z, which is inboard of Position x, and the damper wire tension is reduced. The creep threshold is about 27,000 psi at 460 degrees Celsius for a bimetal and a non bimetal spring. However, the bimetal spring has substantially lower stress at this temperature.

Figure 5:
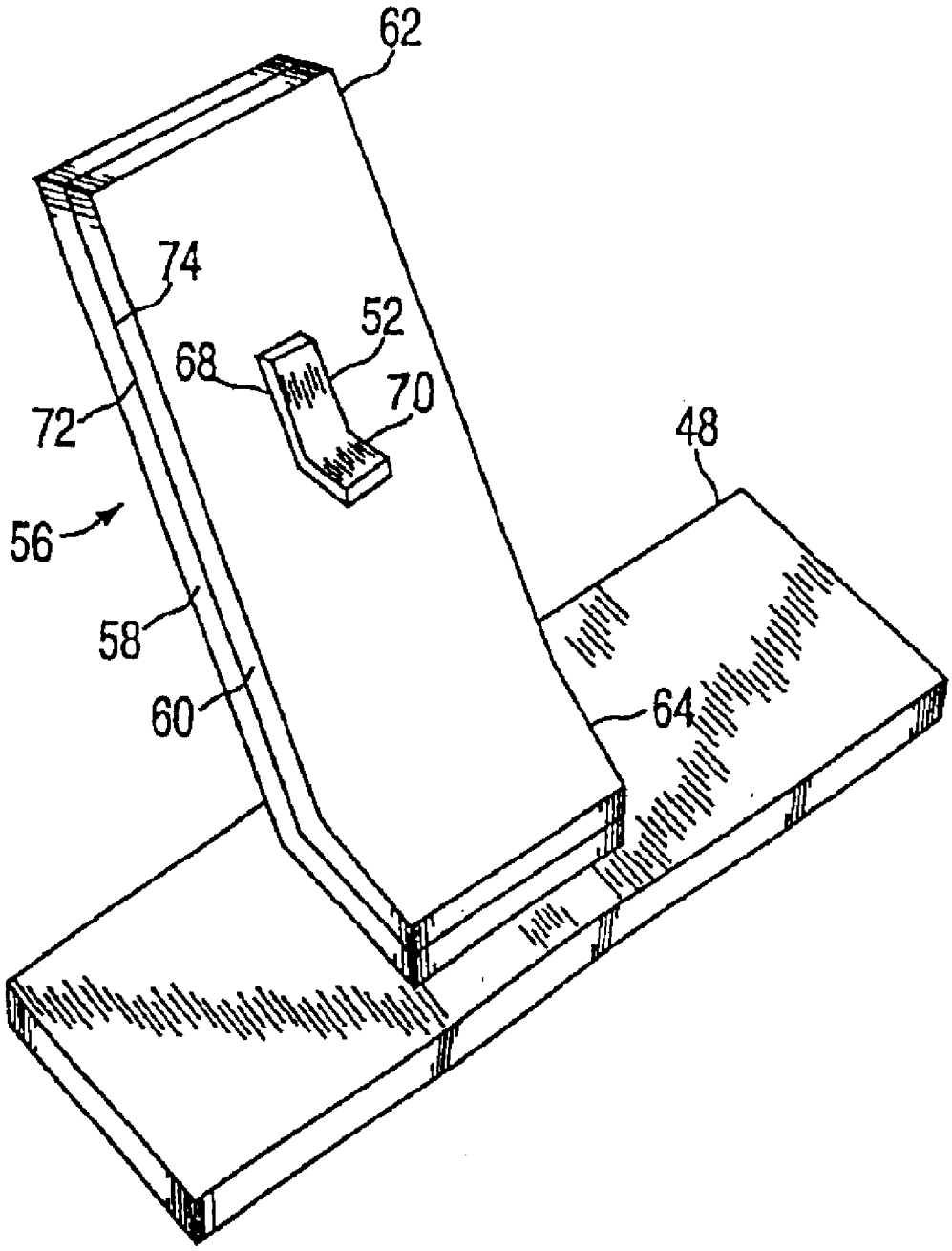
FIG. 5 is a perspective view of a bimetal damper spring.

FIG. 5 depicts a perspective view of a bimetal damper spring that replaces damper spring 50 in FIG. 3. Specifically, bimetal damper spring 56 comprises a first metallic layer 58 and a second metallic layer 60. First metallic layer 58 comprises a metal such as carbon steel and the like disposed on an inner surface 72 of the bimetal damper spring 56. Second metallic layer 60 comprises a metal such as stainless steel and the like, having a higher thermal expansion characteristic than the first metallic layer, disposed on an outer surface 74 of the bimetal damper spring 56. Bimetal damper spring 56 has a thickness of between 0.008" to 0.012" to ensure flexibility. The first metallic layer 58 and second metallic layer 60 may be coupled with welding which can be achieved with electron beam welding or resistance welding.

Bimetal damper spring 56 has a first end 62 and an opposing second end 64. Both of the ends 62 and 64 are flat. The second end 64 of each bimetal damper spring 56 is attached to the frame 48 of the grill type mask 30. Disposed between the first end 62 and second end 64 of each bimetal damper spring 56 is a tab 52 having a first end 68 and an opposing second end 70. The first end 68 of the tab 52 is attached to bimetal damper spring 56.

Figure 6:
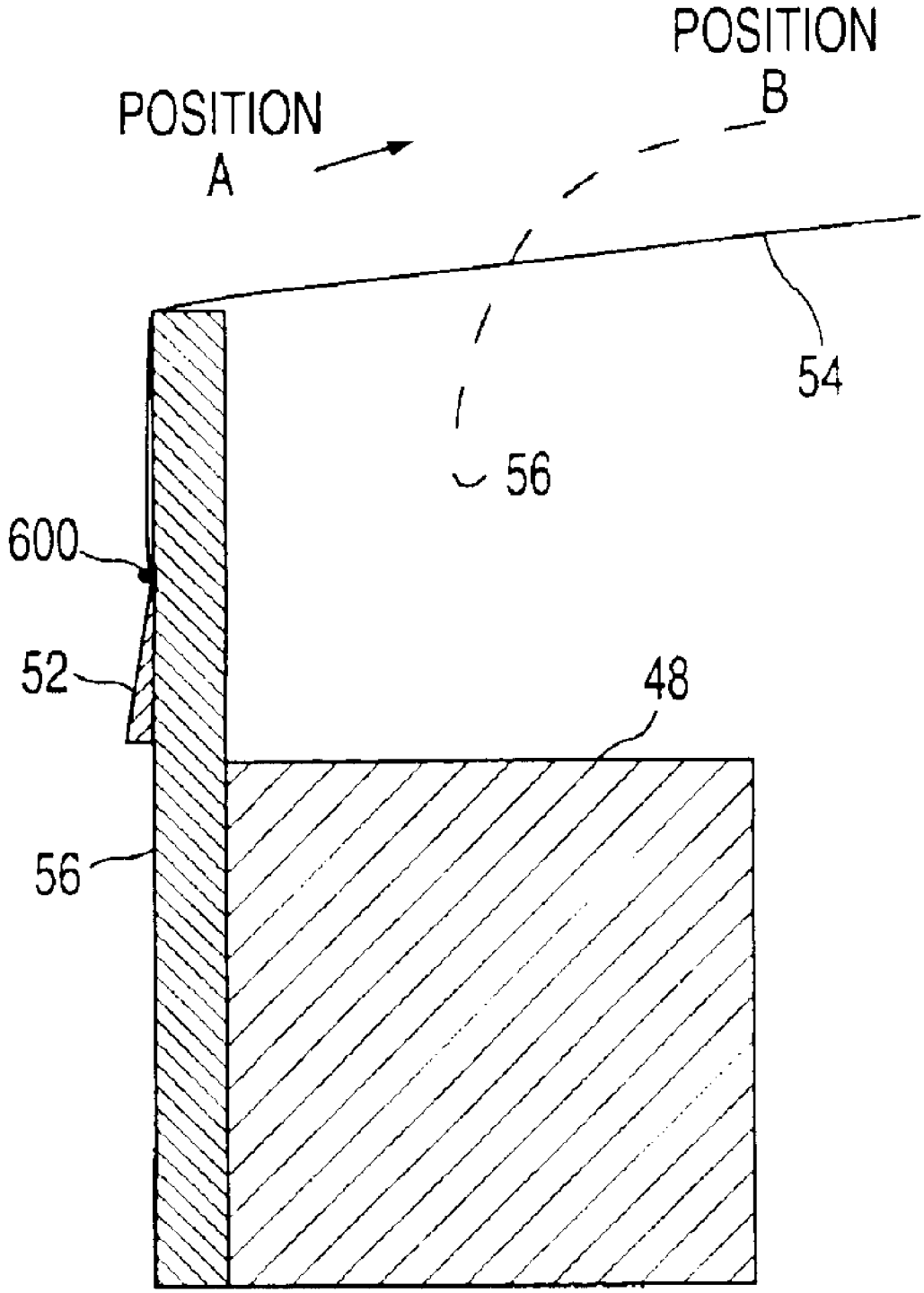
FIG. 6 is a cross sectional view of a bimetal spring depicting positional movement during temperature changes.

FIG. 6 is a cross sectional view of a bimetal spring depicting positional movement during temperature changes. In a first embodiment of the invention, damper wire 54 is spot welded between the tab 52 and bimetal damper spring 56 at point 600. During the cathode ray tube manufacturing process, high temperatures are achieved. Since bimetal damper spring 56 has the low expansion metal on the inner surface 74, the bimetal damper spring 56 curls inward from Position A to Position B. Thus, unloading damper wire 54 during high temperature processing. Thereby, lowering the damper spring and damper wire stress below the creep threshold and allowing damper wire 54 tensions to be fixed before the final cathode ray tube assembly.

Figure 7:
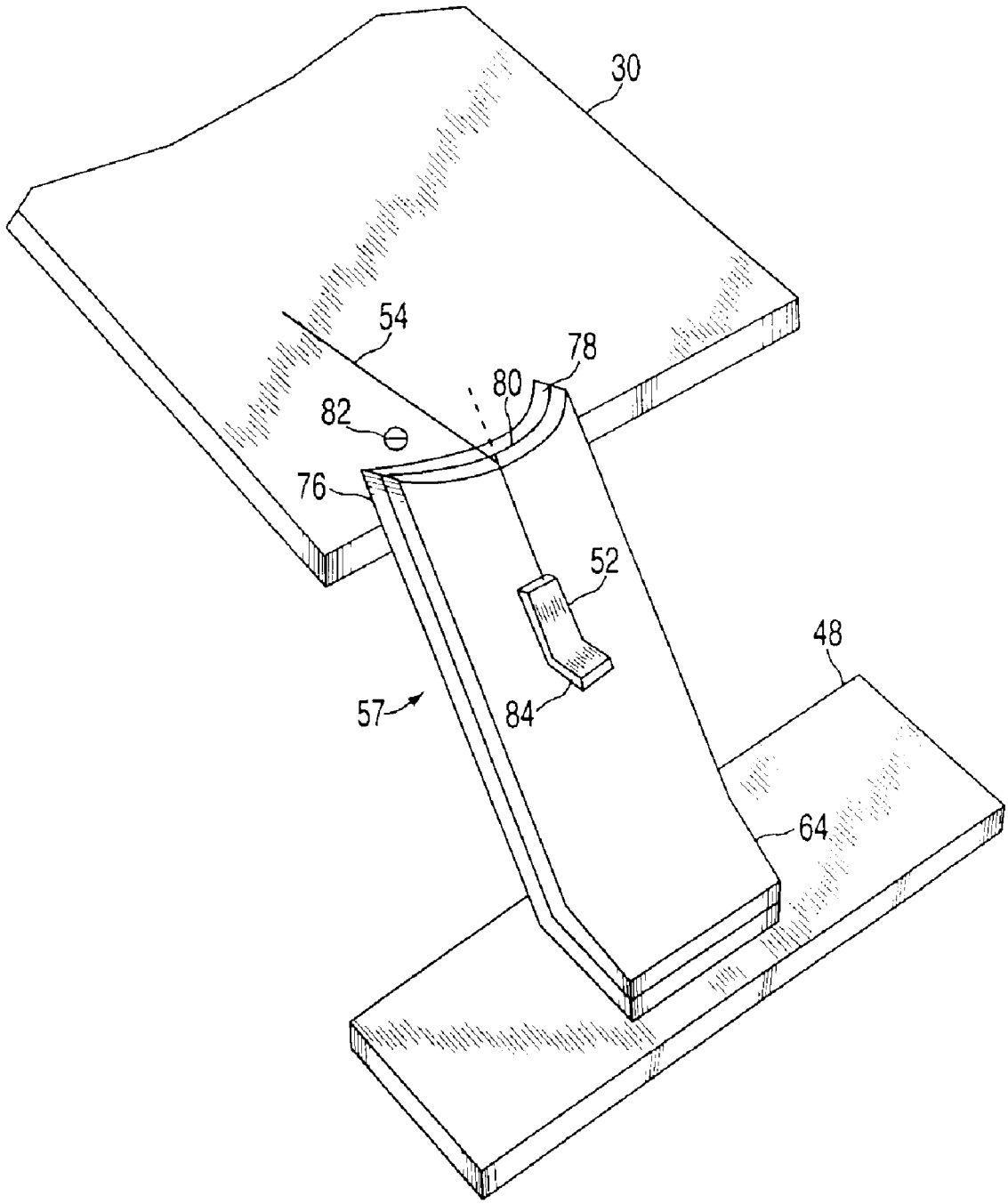
FIG. 7 depicts a perspective view of a bimetal damper spring having a concave first end.

FIG. 7 depicts a perspective view of a bimetal spring 57 having a concave first end 76. Specifically, the bimetal damper spring 57 has a curvature 78 on the first end 76. The curvature 78 is added to first end 76 so that by aligning the apex 80 of the curvature 78 to the edge of the grill type mask 30 with the spring compressed the proper damper wire angle of elevation 82 can be achieved when the spring is released. The preferred radius of the curvature is 1.875" degrees. The proper damper wire angle of elevation 82 is one which guarantees a tangential or slightly downward departure of the damper wire 54 from the edge of the grill type mask 30. Such an angle of elevation guarantees proper contact is maintained with the grill type mask 30 to reduce vibration therein. Factors such as the diameter of the damper wire 54, the degree of curvature of first end 76 and how close the bimetal damper spring 56 is to the edge of the grill type mask 30 determine the damper wire elevation 82. Different degrees of curvature of first end 76 can be used to accommodate any type or size of cathode ray tube 10.

Figure 8:
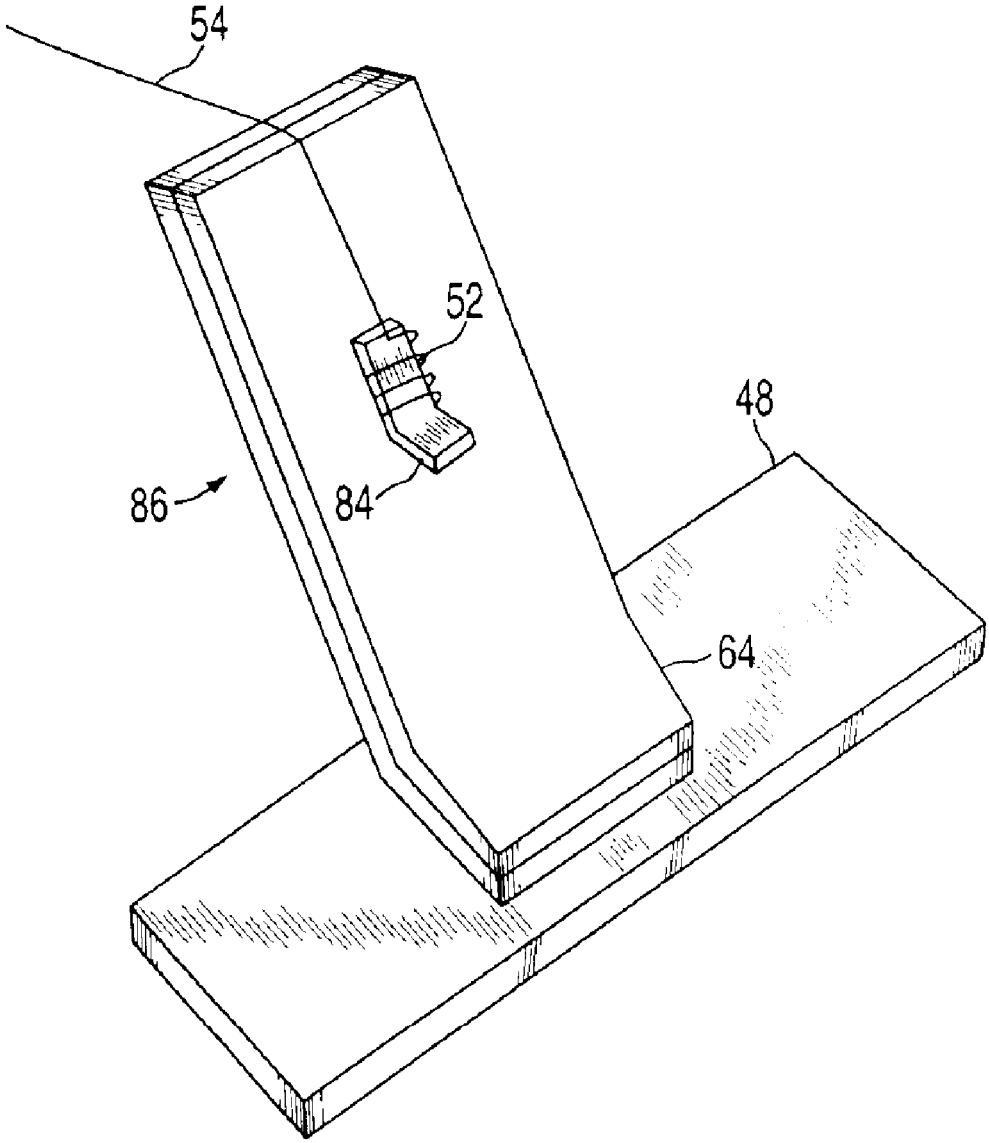
FIG. 8 depicts an embodiment of the invention having a damper wire tied to a respective tab.

FIG. 8 depicts a perspective view of a bimetal damper spring 86 having a damper wire 54 tied to a respective tab 52. Tab 52 is coupled to bimetal damper spring 86 at the first end 62. A crotch 84 exists between tab 52 and bimetal damper spring 86. The damper wire 54 is looped around the tab 52. Then the looped portion of damper wire 54 is secured between damper spring 86 and tab 52 by wedging the looped portion of damper wire 54 in the crotch 84.

It will be appreciated by those skilled in the art that tab 52 can be an integral tab 66 formed from the body of bimetal damper spring 86.

It will also be appreciated by those skilled in the art that the various embodiments of bimetal damper spring 86 can be combined. For example bimetal damper spring 86 can have a first end 76 having a curvature 78 and have damper wire 54 tied to tab 52 of bimetal damper spring 56.

In another embodiment, a non-bimetal damper spring has a concave first end similar to the concave first end shown in FIG. 7. This non-bimetal damper spring benefits from having a damper wire angle of elevation that is adjustable based on the curvature of the first end.

In another embodiment, a non-bimetal damper spring has a damper wire tied to a tab in the same manner as shown in FIG. 8. As such, the damper wire is looped around the tab and the looped portion of the tab is secured by wedging the looped portion of the damper wire in the crotch.

As the embodiments that incorporate the teachings of the present invention have been shown and described in detail, those skilled in the art can readily devise many other varied embodiments that still incorporate these teachings without departing from the spirit of the invention.

What is claimed is:

1. An apparatus for retaining a damper wire on a grill type mask assembly in a cathode ray tube comprising:

a grill type mask assembly having a frame and a mask;

a bimetal damper spring comprising a first metallic layer disposed on a second metallic layer, said bimetal damper spring having a first and an opposing second end, wherein said second end is coupled to said frame and said first metallic layer is formed of a different material than said second metallic layer; and a tab affixed to said bimetal damper spring and adapted to accept said damper wire that traverses the mask, said damper wire being coupled between said tab and said bimetal damper spring.

2. The apparatus of claim 1, wherein said first metallic layer comprises carbon steel.

3. The apparatus of claim 1, wherein said second metallic layer comprises stainless steel.

4. The apparatus of claim 1, wherein said first metallic layer is disposed on an inner surface of said bimetal damper spring for allowing the bimetal damper spring to curl inward and unload the damper wire during high temperature processing.

5. The apparatus of claim 1, wherein the second metallic layer is disposed on an outer surface of said bimetal damper spring for allowing the bimetal damper spring to exert tension on the damper wire during normal operating temperature.

6. The apparatus of claim 1, wherein the first end of the bimetal damper spring is structured having a curvature perpendicular to the first end of the bimetal damper spring, for allowing the damper wire attached to the tab to have a controllable elevation with respect to the mask.

7. The apparatus of claim 1, wherein the damper wire is coupled between the tab and the bimetal damper spring by welding the damper wire to the tab and the bimetal damper spring.

8. The apparatus of claim 1, wherein said damper wire is coupled to the tab by looping the wire around the tab and wedging the damper wire in a crotch between the tab and the bimetal damper spring.

9. A grill type mask assembly in a cathode ray tube, comprising:

a frame;

a mask, including strands, disposed within said frame; and a damper spring coupled to said mask including a portion formed by a first layer having a first coefficient of thermal expansion coupled to a portion formed by a second layer having a higher coefficient of thermal expansion, said second layer substantially covering said first layer on a side of said damper spring facing away from said mask and coupled to said mask through said first layer arranged therebetween for varying a tension in said damper spring to compensate for changes induced by corresponding changes in temperature within said cathode ray tube.

10. The apparatus of claim 9, wherein said first and second layer are coupled to form a bi-metal arrangement.

11. The apparatus of claim 9, wherein a damper wire that traverses the mask is coupled to said first and second layers that compensate for a change in a length of said damper wire induced by temperature changes.

12. The apparatus of claim 11, wherein a tab is formed on said damper spring and adapted to accept said damper wire.

13. A method of attaching a damper wire to a mask assembly of a cathode ray tube, comprising:

looping the damper wire between a tab and a damper spring that is attached to the mask assembly; and securing said looped wire in a crotch between the tab and the damper spring.

* * * * *